US009666386B2

(12) United States Patent
Touchette et al.

(10) Patent No.: US 9,666,386 B2
(45) Date of Patent: May 30, 2017

(54) KEYBOARD INTEGRATED PUSHBUTTON WITH MULTI ILLUMINATION

(71) Applicant: Astronics Corporation, Orchard Park, NY (US)

(72) Inventors: Julien Touchette, Montreal (CA); Colin Dassigli, Montreal (CA)

(73) Assignee: Astronics Corporation, East Aurora, NY (US)

( * ) Notice: Subject to any disclaimer, the term of this patent is extended or adjusted under 35 U.S.C. 154(b) by 0 days.

(21) Appl. No.: 14/269,953

(22) Filed: May 5, 2014

(65) Prior Publication Data

US 2014/0332360 A1 Nov. 13, 2014

Related U.S. Application Data

(60) Provisional application No. 61/820,657, filed on May 7, 2013.

(51) Int. Cl.
*H01H 9/26* (2006.01)
*H01H 13/72* (2006.01)
(Continued)

(52) U.S. Cl.
CPC ..... *H01H 13/023* (2013.01); *H01H 13/83* (2013.01); *H01H 2013/026* (2013.01); *H01H 2219/039* (2013.01); *H01H 2221/07* (2013.01)

(58) Field of Classification Search
CPC .. H01H 9/02; H01H 9/26; H01H 9/18; H01H 9/181; H01H 9/185; H01H 9/161; H01H 9/16; H01H 9/162; H01H 13/72; H01H 13/76; H01H 13/00; H01H 13/50; H01H 2003/12; H01H 2009/02; H01H 2009/16; H01H 2009/161; H01H 2003/00; H01H 2219/014; H01H 2219/036; H01H 2219/037; H01H 2219/039; H01H 2219/054; H01H 2219/062; H01H 2221/07; H01H 3/12; H01H 2013/00; H01H 2223/00; H01H 2223/034; H01H 2223/036; H01H 2223/038; H01H 2223/042;
(Continued)

(56) References Cited

U.S. PATENT DOCUMENTS 4,439,646 A * 3/1984 Bouvrande ..... H01H 13/7006 200/275
8,783,884 B2 * 7/2014 Baker et al. ..... 362/23.05
(Continued)

*Primary Examiner* — Anthony R Jimenez
(74) *Attorney, Agent, or Firm* — Hodgson Russ LLP

(57) ABSTRACT

A multi-illuminated pushbutton, including a substrate having a switch and a button cap. A lighting board may be affixed to the substrate, the lighting board having a first light source, a second light source, and a through channel disposed between the first light source and the second light source. The button cap can have a first window for transmission of light from the first light source, a second window for transmission of light from the second light source, and a button base disposed through the channel of the lighting board and in operable relation with the switch. The button base can be shaped to prevent substantially all light emitted from the first light source from transmission through the second window and prevents substantially all light emitted from the second light source from transmission through the first window.

20 Claims, 5 Drawing Sheets

(51) Int. Cl.
*H01H 13/76* (2006.01)
*H01H 13/02* (2006.01)
*H01H 13/83* (2006.01)

(58) Field of Classification Search
CPC ..... H01H 2223/044; H01H 2223/056; H01H 2233/00; H01H 2233/03; H01H 13/023; H01H 13/83; H01H 2013/026
USPC ..... 200/5 A, 5 E, 50.03, 553, 293, 200/302.1–302.3, 329, 341, 343, 345
See application file for complete search history.

(56) References Cited

U.S. PATENT DOCUMENTS

2011/0108403 A1* 5/2011 Kukita ..... H01H 13/14 200/341
2012/0314396 A1* 12/2012 Pope et al. ..... 362/23

* cited by examiner

KEYBOARD INTEGRATED PUSHBUTTON WITH MULTI ILLUMINATION

CROSS REFERENCE TO RELATED APPLICATIONS

The present application claims the benefit of the earlier filing date of U.S. Provisional Patent Application No. 61/820,657, filed May 7, 2013, the disclosure of which is incorporated herein by reference in its entirety.

FIELD OF THE DISCLOSURE

The disclosure relates to annunciators having illumination to indicate state, and more particularly, pushbuttons.

BACKGROUND OF THE DISCLOSURE

Multi-legend pushbuttons are used for indicating the state of a switch using multiple light sources and windows in the buttons to allow transmission of the light. In a simplistic example, a button may have a first window through which light from a first light source passes when an aircraft door is open, and a second window through which light from a second light source passes when the aircraft door is closed.

Previous multi-legend pushbuttons have lights with a lighting circuit integrated to the button cap—that portion of the pushbutton which moves when the pushbutton is actuated. The button lighting (typically light-emitting diodes ("LEDs"), and the corresponding lighting circuit, is therefore consolidated with the button caps and moves when the pushbutton is actuated. Each lighting circuit is electrically connected to a main circuit for at least the provision of power. The electrical connection must accommodate the movement of the button lighting relative to the main circuit.

In the example of a prior art pushbutton shown in FIGS. 1-3, the lighting and lighting circuit is provided on a flexible printed circuit board installed inside the button assembly. The flex circuit is soldered to a PCB of the main circuit (the main PCB) in order to provide legend lighting. The button cap is composed of opaque and transparent materials to isolate the light of the multiple light sources. One of the problems with such previous multi-illumination buttons is that the conductors and connections of the lighting circuit are mechanically stressed each time the pushbutton is actuated due to the button movement.

BRIEF SUMMARY OF THE DISCLOSURE

The advancement achieved with pushbuttons according to the present disclosure is that there is no illuminated circuit board which moves with the button key. The lighting circuit and conductors are generally static such that the device will not wear as quickly as previous pushbutton designs. The separation of the button envelope and its lighting also allows for a more robust structure and improved manufacturability.

The present application may be embodied as a multi-illuminated pushbutton, including a substrate having a switch and a button cap. A lighting board may be affixed to the substrate, the lighting board having a first light source, a second light source, and a through channel disposed between the first light source and the second light source. The button cap can have a first window for transmission of light from the first light source, a second window for transmission of light from the second light source, and a button base disposed through the channel of the lighting board and in operable relation with the switch. The button base can be shaped to prevent substantially all light emitted from the first light source from transmission through the second window and prevents substantially all light emitted from the second light source from transmission through the first window.

The present application may be also embodied as an aircraft control panel, the panel including a plurality of multi-illuminated pushbuttons. Each pushbutton can include a substrate having a switch and a button cap. A lighting board may be affixed to the substrate, the lighting board having a first light source, a second light source, and a through channel disposed between the first light source and the second light source. The button cap can have a first window for transmission of light from the first light source, a second window for transmission of light from the second light source, and a button base disposed through the channel of the lighting board and in operable relation with the switch. The button base can be shaped to prevent substantially all light emitted from the first light source from transmission through the second window and prevents substantially all light emitted from the second light source from transmission through the first window.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Figure 1:
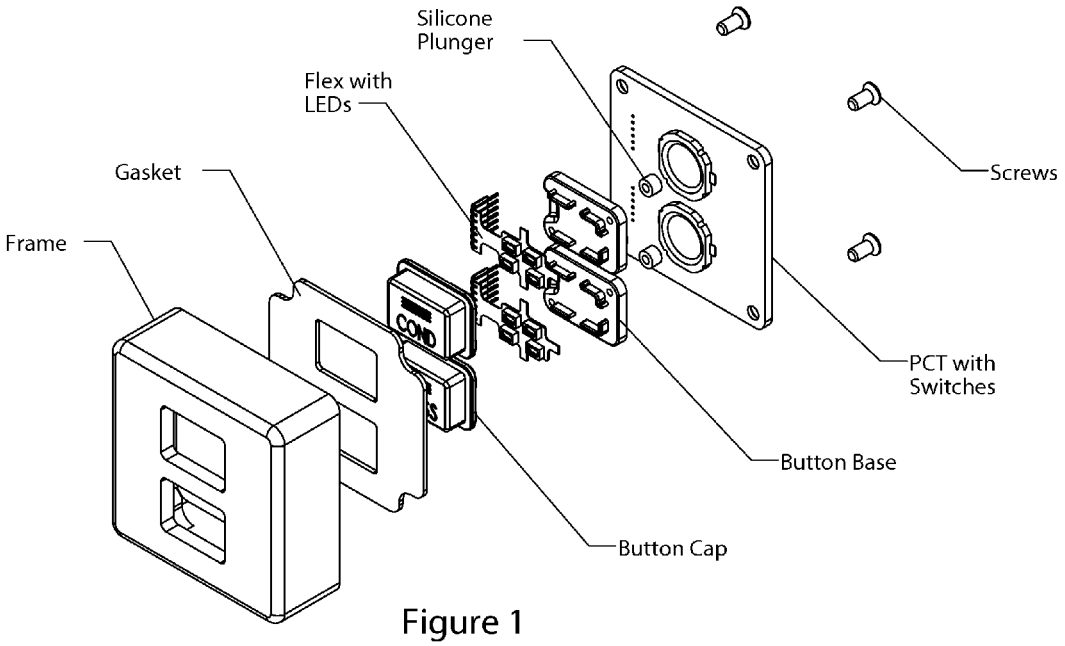
Figure 1 Prior Art
FIG. 1 is an exploded view diagram of a prior art multi-illumination device having two pushbuttons with a flex circuit.
Figure 2:
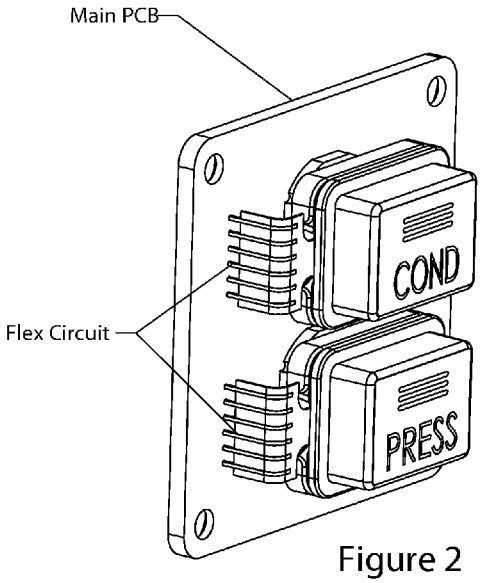
Figure 2 Prior Art
FIG. 2 is a perspective view of the prior art pushbuttons of FIG. 1.
Figure 3A:
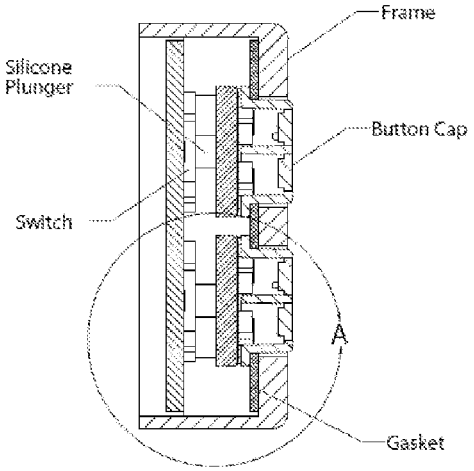
Figure 3A Prior Art
FIG. 3A is a side cross-sectional view of the of the prior art pushbuttons of FIGS. 1 and 2.
Figure 3B:
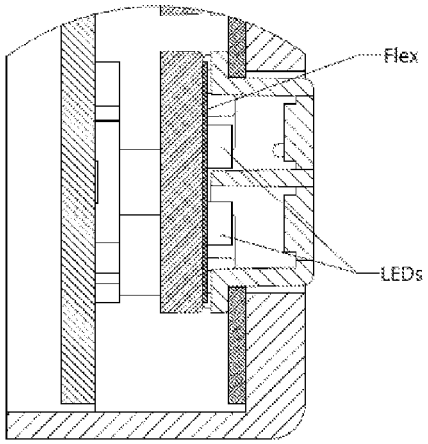
Figure 3B Prior Art
FIG. 3B is a cross-sectional view of detail 'A' of FIG. 3A.
Figure 4B:
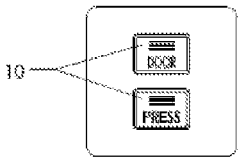
FIG. 4B is a front view of the pushbutton device of FIG. 4A.
Figure 4A:
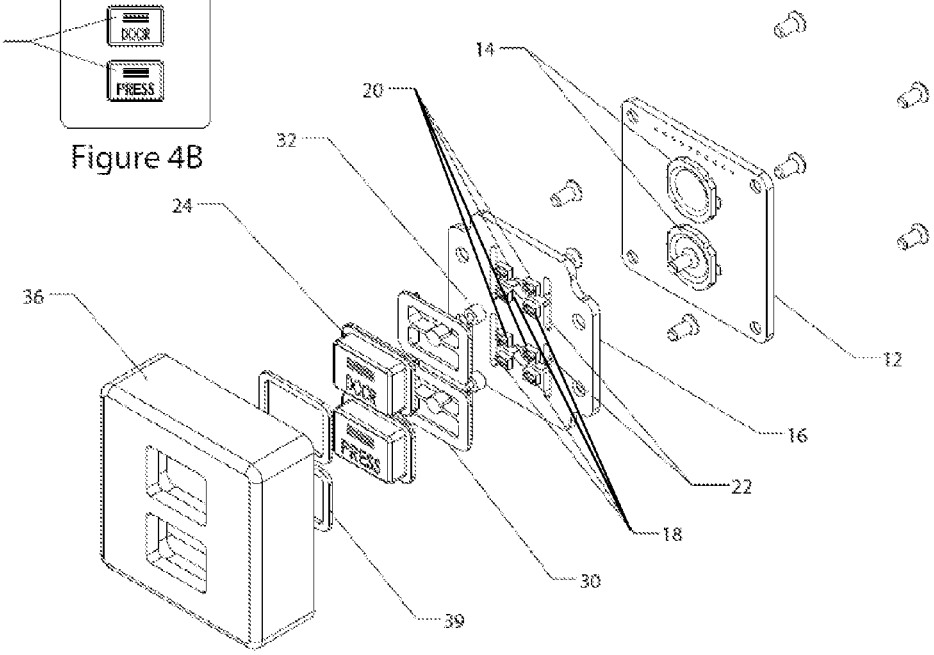
FIG. 4A is an exploded view diagram of a pushbutton device having two buttons according to an embodiment of the present disclosure.
Figure 5A:
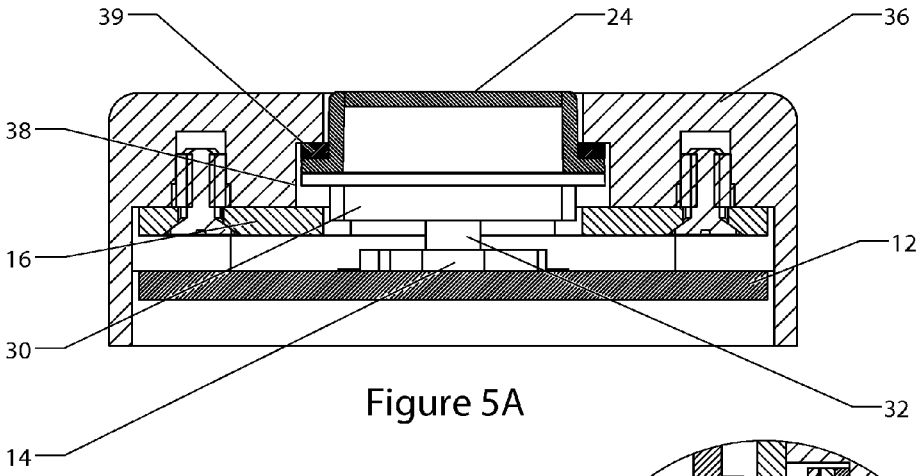
FIG. 5A is a top cross-sectional view of the pushbutton device of FIG. 4A.
Figure 5B:
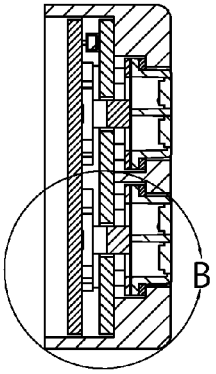
FIG. 5B is a side cross-sectional view of the pushbutton device of FIGS. 4A and 5A.
Figure 5C:
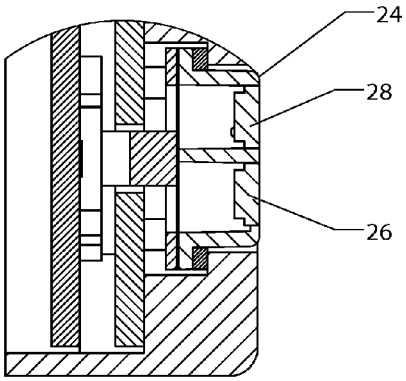
FIG. 5C is a cross-sectional view of detail 'B' of FIG. 5B.
Figure 6:
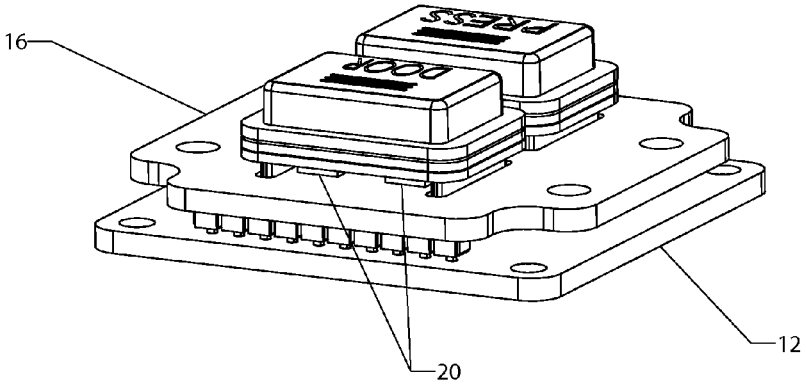
FIG. 6 is a perspective view of the pushbutton device of FIG. 4A.

The present disclosure may be embodied as a pushbutton device 10 (see, e.g., FIGS. 4A-6). Pushbutton 10 is a multi-illuminated device (sometimes referred to as a multi-legend device). Pushbutton 10 comprises a substrate 12 having a switch 14. Substrate 12 may be, for example, a rigid printed circuit board ("PCB") on which the switch 14 is mounted. Switch 14 may be an on-off switch, a non-latching switch, such as a momentary on or momentary off switch, or any other type of switch suitable to the application.

A lighting board 16 is affixed to the substrate 12. The lighting board 16 may comprise a PCB. The lighting board 16 has a first light source 18 which is configured to emit light when the pushbutton 10 has a first state, and a second light source 20, which is configured to emit light when the pushbutton 10 has a second state. The first light source 18 and/or the second light source 20 may each comprise one or more LEDs. The first light source 18 may be the same or different color from that of the second light source 20. The lighting board 16 has a through channel 22 disposed between the first light source 18 and the second light source 20. The lighting board 16 is affixed to the substrate 12 such that the through channel 22 of the lighting board 16 is proximate the switch 14 and the switch 14 is accessible via the through channel 22.

The pushbutton 10 further comprises a button cap 24, which is operable by a user of the pushbutton to actuate the pushbutton 10. The button cap 24 may be configured to at least partially cover the first and second light sources 18, 20. The button cap 24 is generally opaque and has a first window 26 for transmission of light from the first light source 18 to indicate a first state. The first window 26 may be configured in the shape of one or more letters and/or icons to communicate a state. For example, the first window 26 may be shaped to form the word "DOOR." The button cap 24 has a second window 28 for transmission of light from the second light source 20 to indicate a second state. The first and/or second windows 26, 28 may be tinted such that the transmitted light has a color. The first window 26 may be the same or different color from that of the second window 28.

The indicated state may be a state of the pushbutton 10 or the state of a device in communication with the pushbutton 10. For example, the pushbutton 10 may be in electrical communication with a door of an aircraft. When the door is closed, the first and second light sources 18, 20 of the pushbutton 10 may be off (not emitting light). When the door is opened, the first light source 18 may turn on and, for example, an audible alarm may sound. When the pushbutton 10 is actuated, the audible alarm may be silenced, the first light source 18 may turn off, and the second light source 20 may turn on. When the door is closed again, the second light source 20 of the pushbutton 10 may turn off. Other ways of using multi-legend pushbuttons are known in the art and/or will be apparent and are considered to be within the scope of this disclosure.

The button cap 24 has a button base 30, which may form an integral part of the button cap 24 or be separate from the button cap 24. At least a portion of the button base 30 is disposed in the through channel 22 of the lighting board 16. The button base 30 is in operable relation with the switch 14 such that when the button cap 24 is actuated by a user, the button base 30 moves the through channel 22 to actuate the switch 14. In this way, the button base 30 may be said to be in mechanical communication with the switch 14. A plunger 32 may be disposed between the button base 30 and the switch 14. The plunger 32 may be formed of a resilient material, such as, for example, silicone, such the button cap 24 will return to an non-actuated position when released by a user.

At least a portion of the button base 30 is opaque and shaped to isolate light from the first and second light sources 18, 20. In particular, at least a portion of the button base 30 is shaped to prevent substantially all light emitted from the first light source 18 from transmission through the second window 28. Similarly, at least a portion of the button base 30 is shaped to prevent substantially all light emitted from the second light source 20 from transmission through the first window 26. The through channel 22 of the lighting board 16 is shaped to substantially correspond with the shape of the button base 30. In some embodiments, preventing substantially all light emitted from a first light source 18 from transmission through the second window 28 should be interpreted to mean that a person observing the pushbutton 10 would recognize that the pushbutton 10 is not in the second state when light from the first light source 18 is visible through the first window 26.

Figure 7:
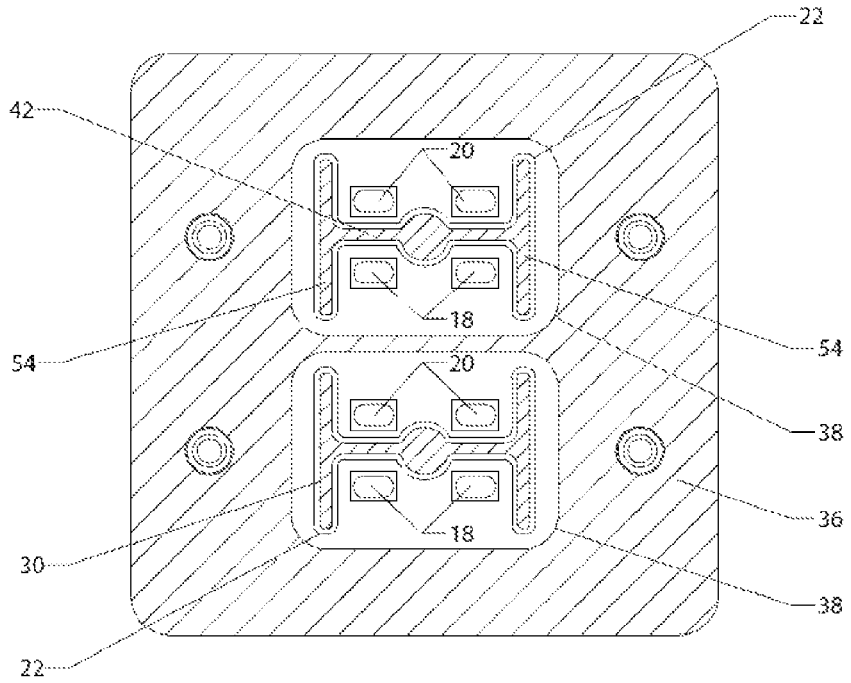
FIG. 7 is a top view diagram of a portion of the pushbutton device of FIG. 4A; showing the frame and the PCB viewable through the button orifices of the frame.

In an exemplary embodiment, best depicted in FIG. 7, the button base 30 (and the corresponding through channel 22) has a shape roughly similar to that of a letter 'H.' Each of the first light source 18 (two LEDs) and second light source 20 (two LEDs) are disposed on either side of the horizontal portion 42 of the exemplary 'H'-shaped through channel 22. In this manner, when the pushbutton 10 is assembled and the button base 30 is present in the through channel 22, the horizontal portion 42 and vertical portions 54 of the 'H'-shaped button base 30 isolates the light emitted by the first and second light sources 18, 20. Other configurations of button bases will be apparent in light of this disclosure.

The pushbutton 10 may further comprise a frame 36 having a button orifice 38. The frame 36 is configured to contain at least a portion of the substrate 12, the lighting board 16, and the button cap 24. The button cap 24 is accessible via the button orifice 38, and the button cap 24 may be disposed in the button orifice 38. It should be noted that the frame 36 depicted in the figures includes two button orifices 38 and is configured for more than one button assembly. Frames may be configured for one or more buttons. The button cap 24 may have a ledge portion 34 configured so that the button cap 24 is larger than the button orifice 38 of the frame 36. In this way, the button cap 24 may be disposed in the button orifice 38 and prevented from moving completely out of the button orifice 38. The pushbutton 10 may further comprise a gasket 39 disposed between the button cap 24 and the frame 36, for example, between the ledge portion 38 and the portion of the frame 36 adjacent to the button orifice 38.

Figure 8:
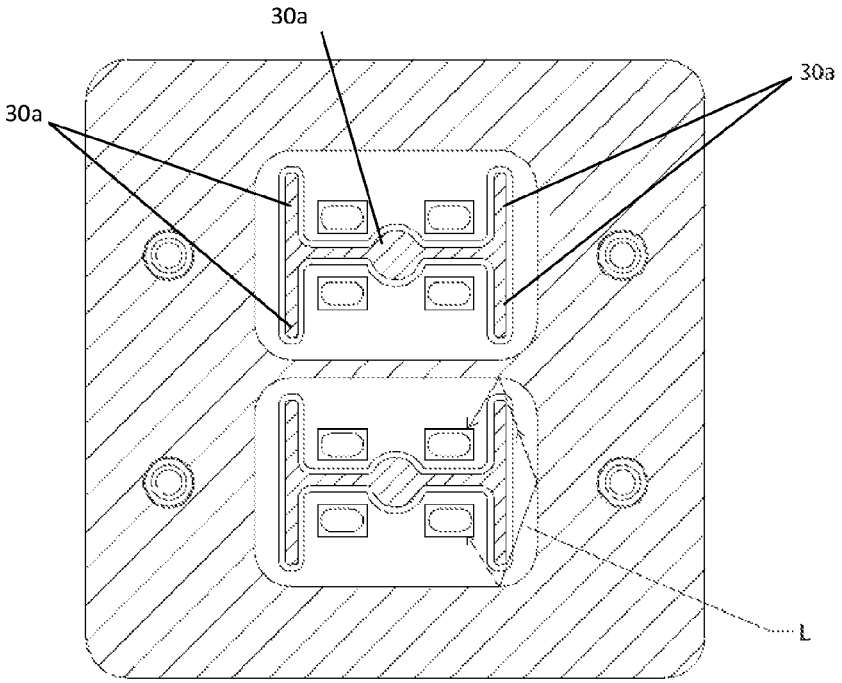
FIG. 8 is an annotated top view diagram of a portion of a pushbutton device according to another embodiment of the present disclosure, showing a PCB with four pushbutton locations.

As can be seen in the exemplary embodiment of FIG. 8, the button base 30 passes through the lighting board 16 and prevents light leakage between windows 26, 28. For example, the button base 30 can include one or more walls 30*a*, which may create a path too complicated for light path L to travel between first and second light sources 18, 20 and/or between one of the light sources 18, 20 and an opposing window 26, 28. The button base 30 can also be configured to prevent light leakage to neighboring button(s).

In one particular example, the lighting circuit may have an 'H' shaped hole for each button. The light sources are installed on the circuit both sides of the 'H' shape. The button base passes through the lighting circuit and with its 'H' shaped walls blocks the light sources to create the multi illuminations. The button base is slightly smaller than the hole in the circuit to allow key movement. There is a frame envelope around the keys that prevents light leakage to neighboring buttons.

In another embodiment, the device comprises a frame, a button assembly, a lighting circuit and a switch circuit. The button of the present disclosure is separated from its respective illumination circuit. The lighting circuit is static, attached to frame. The button assembly passes through the lighting circuit (lighting board) to achieve actuation of the switch on the second PCB (substrate). The connection between the lighting PCB and main PCB is not affected by the button movement.

Figure 9:
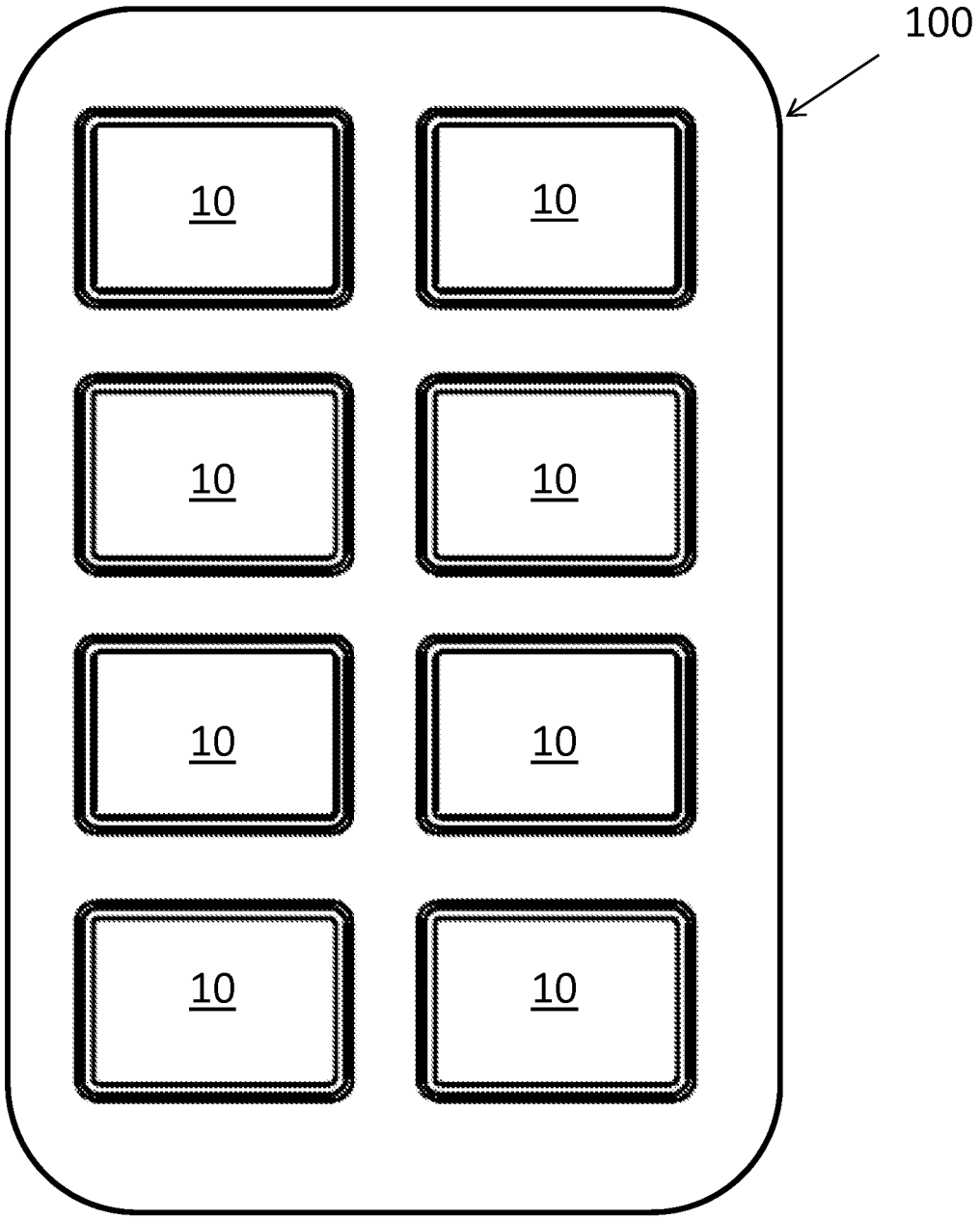
FIG. 9 is a schematic view of a control panel according to another embodiment of the present disclosure.

FIG. 9 depicts a schematic representation of another embodiment of the present application. In this embodiment, a plurality of pushbuttons 10 are provided on a control panel 100. The control panel 100 can provide improved and more reliable control of instruments. The control panel 100 may be installed on a vehicle, for example, an aircraft or automobile.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A multi-illuminated pushbutton, comprising:

a substrate having a switch;

a lighting board affixed to the substrate, the lighting board having a first light source configured to emit light to indicate a first state, a second light source configured to emit light to indicate a second state, and a through channel disposed between the first light source and the second light source;

a button cap having a first window for transmission of light from the first light source, a second window for transmission of light from the second light source, and a button base disposed through the through channel of the lighting board and in operable relation with the switch; and wherein the button base has a shape that prevents substantially all light emitted from the first light source from transmission through the second window and prevents substantially all light emitted from the second light source from transmission through the first window.

2. The pushbutton of claim 1, wherein the button base is separate from the button cap.

3. The pushbutton of claim 1, further comprising a frame having a button orifice, the frame configured to contain at least a portion of the substrate, the lighting board, and the button cap; and wherein the button cap is operably disposed through the button orifice such that a user may actuate the button cap.

4. The pushbutton of claim 3, further comprising a gasket disposed between the button cap and the frame.

5. The pushbutton of claim 1, further comprising a plunger disposed between the button base and the switch.

6. The pushbutton of claim 1, wherein the first light source comprises one or more light-emitting diodes ("LEDs").

7. The pushbutton of claim 1, wherein the second light source comprises one or more LEDs.

8. The pushbutton of claim 1, wherein the first window, the second window, or both the first and the second windows are configured as letters.

9. The pushbutton of claim 1, wherein the first window, the second window, or both the first and the second windows are configured as icons.

10. The pushbutton of claim 1, wherein the lighting board comprises a PCB.

11. The pushbutton of claim 1, wherein the substrate comprises a PCB.

12. A multi-illuminated pushbutton, comprising:

a substrate having a switch;

a lighting board affixed to the substrate, the lighting board having a first light source configured to emit light to indicate a first state, a second light source configured to emit light to indicate a second state, and a through channel disposed between the first light source and the second light source;

a button cap having a first window for transmission of light from the first light source, a second window for transmission of light from the second light source, and a button base disposed through the through channel of the lighting board and arranged to actuate the switch; and wherein the button base includes at least one wall disposed between the first light source and the second light source, the at least one wall separating the first light source and the first window from the second light source and the second window.

13. The multi-illuminated pushbutton of claim 12, wherein the lighting board is fixed relative to the substrate such that the lighting board is stationary when the pushbutton is moved between a rest state and a depressed state.

14. The multi-illuminated pushbutton of claim 13, wherein the at least one wall includes a plurality of walls.

15. The multi-illuminated pushbutton of claim 14, wherein the button base is separate from the button cap.

16. The multi-illuminated pushbutton of claim 15, wherein the lighting board comprises a PCB.

17. The multi-illuminated pushbutton of claim 16, wherein the substrate comprises a PCB.

18. A control panel, comprising:

a panel including a plurality of multi-illuminated pushbuttons, each pushbutton, including:

a substrate having a switch;

a lighting board affixed to the substrate, the lighting board having a first light source configured to emit light to indicate a first state, a second light source configured to emit light to indicate a second state, and a through channel disposed between the first light source and the second light source;

a button cap having a first window for transmission of light from the first light source, a second window for transmission of light from the second light source, and a button base disposed through the through channel of the lighting board and in operable relation with the switch; and a frame having a button orifice, the frame configured to contain at least a portion of the substrate, the lighting board, and the button cap;

wherein the button cap is operably disposed through the button orifice such that a user may actuate the button cap;

wherein the button base has a shape that prevents substantially all light emitted from the first light source from transmission through the second window and prevents substantially all light emitted from the second light source from transmission through the first window;

wherein the lighting board comprises a PCB; and wherein the substrate comprises a PCB.

19. The control panel of claim 18, wherein the control panel is installed in an aircraft.

20. The control panel of claim 19, wherein the control panel is configured to control instruments on the aircraft.

* * * * *